US011005181B2

(12) United States Patent
Leipold et al.

(10) Patent No.: US 11,005,181 B2
(45) Date of Patent: May 11, 2021

(54) MULTI-LAYER ANTENNA ASSEMBLY AND RELATED ANTENNA ARRAY

(71) Applicant: Qorvo US, Inc., Greensboro, NC (US)

(72) Inventors: Dirk Robert Walter Leipold, San Jose, CA (US); George Maxim, Saratoga, CA (US); Nadim Khlat, Cugnaux (FR); Baker Scott, San Jose, CA (US)

(73) Assignee: Qorvo US, Inc., Greensboro, NC (US)

( * ) Notice: Subject to any disclaimer, the term of this patent is extended or adjusted under 35 U.S.C. 154(b) by 177 days.

(21) Appl. No.: 16/202,563

(22) Filed: Nov. 28, 2018

(65) Prior Publication Data

US 2020/0028266 A1 Jan. 23, 2020

Related U.S. Application Data

(60) Provisional application No. 62/699,793, filed on Jul. 18, 2018.

(51) Int. Cl.

| | |
|---|---|
| ***H01Q 1/38*** | (2006.01) |
| ***H01Q 9/04*** | (2006.01) |
| ***H01Q 1/42*** | (2006.01) |
| ***H01Q 1/24*** | (2006.01) |
| ***H01Q 15/00*** | (2006.01) |

(52) U.S. Cl.

CPC ..... *H01Q 9/0414* (2013.01); *H01Q 1/243* (2013.01); *H01Q 1/245* (2013.01); *H01Q 1/424* (2013.01); *H01Q 15/0026* (2013.01)

(58) Field of Classification Search

CPC ..... H01Q 9/0414; H01Q 1/424; H01Q 1/243; H01Q 1/245; H01Q 15/0026; H01Q 1/38; H01Q 3/24; H01Q 21/205

See application file for complete search history.

(56) References Cited

U.S. PATENT DOCUMENTS

2014/0197994 A1* 7/2014 Hossain ..... H01Q 9/0414 343/700 MS
2019/0103653 A1* 4/2019 Jeong ..... H01L 23/28

* cited by examiner

*Primary Examiner* — Dieu Hien T Duong
(74) *Attorney, Agent, or Firm* — Withrow & Terranova, P.L.L.C.

(57) ABSTRACT

A multi-layer antenna assembly and related antenna array are provided. In one aspect, a multi-layer antenna assembly includes a first radiating layer(s) and a second radiating layer(s). The second radiating layer(s) is provided below and in parallel to the first radiating layer(s). The second radiating layer(s) overlaps at least partially with the first radiating layer(s). In this regard, an electromagnetic wave radiated vertically from the second radiating layer(s) is horizontally guided by an overlapping portion of the first radiating layer(s). In another aspect, an antenna array can be configured to include a number of multi-layer antenna assemblies to enable radio frequency (RF) beamforming. By employing the multi-layer antenna assemblies in the antenna array, it may be possible to flexibly and naturally steer an RF beam in a desired direction(s) without causing oversized side lobes, thus helping to improve power efficiency and performance of the antenna array.

20 Claims, 9 Drawing Sheets

MULTI-LAYER ANTENNA ASSEMBLY AND RELATED ANTENNA ARRAY

RELATED APPLICATIONS

This application claims the benefit of provisional patent application Ser. No. 62/699,793, filed Jul. 18, 2018, the disclosure of which is hereby incorporated herein by reference in its entirety.

FIELD OF THE DISCLOSURE

The technology of the disclosure relates generally to an antenna structure(s).

BACKGROUND

Mobile communication devices have become increasingly common in current society for providing wireless communication services. The prevalence of these mobile communication devices is driven in part by the many functions that are now enabled on such devices. Increased processing capabilities in such devices means that mobile communication devices have evolved from being pure communication tools into sophisticated mobile multimedia centers that enable enhanced user experiences.

Fifth-generation (5G) wireless communication technology has been widely regarded as the next generation of wireless communication standards beyond the current third-generation (3G) and fourth-generation (4G) communication standards. A 5G-capable mobile communication device is expected to achieve significantly higher data rates, improved coverage range, enhanced signaling efficiency, and reduced latency compared to a conventional mobile communication device supporting only the 3G and/or 4G communication standards.

The 5G-capable mobile communication device can be configured to transmit a 5G RF signal(s) in millimeter wave (mmWave) spectrum(s) that is typically higher than 18 GHz. Accordingly, the 5G RF signal(s) is also referred to as an mmWave RF signal(s) hereinafter. Notably, the mmWave RF signal(s) can be susceptible to attenuation and interference resulting from various sources. As such, the 5G-capable mobile communication device typically employs an antenna array(s) that includes a number of antennas to concurrently radiate the 5G RF signal(s) in an RF beam. By steering the RF beam toward a receiving device, it may be possible to mitigate attenuation and interference of the 5G RF signal(s), thus helping to improve coverage range and data throughput of the 5G-capable mobile communication device. However, when the RF beam is steered toward a direction non-perpendicular to the antenna array(s), considerably larger side lobes may be generated as a result. As the side lobes can reduce total power in a main lobe of the RF beam and/or cause so-called skin-effect to users of the 5G-capable mobile communication device, it may be desirable to design the antenna array(s) to flexibly and naturally steer the RF beam in a desired direction without causing oversized side lobes.

SUMMARY

Embodiments of the disclosure relate to a multi-layer antenna assembly and related antenna array. In one aspect, a multi-layer antenna assembly includes a first radiating layer(s) and a second radiating layer(s). The second radiating layer(s) is provided below and in parallel to the first radiating layer(s). The second radiating layer(s) overlaps at least partially with the first radiating layer(s). In this regard, an electromagnetic wave radiated vertically from the second radiating layer(s) is horizontally guided by an overlapping portion of the first radiating layer(s). In another aspect, an antenna array can be configured to include a number of multi-layer antenna assemblies to enable radio frequency (RF) beamforming. By employing the multi-layer antenna assemblies in the antenna array, it may be possible to flexibly and naturally steer an RF beam in a desired direction(s) without causing oversized side lobes, thus helping to improve power efficiency and performance of the antenna array.

In one aspect, a multi-layer antenna assembly is provided. The multi-layer antenna assembly includes at least one first radiating layer. The multi-layer antenna assembly also includes at least one second radiating layer provided below and parallel to the at least one first radiating layer. The at least one second radiating layer overlaps at least partially with the at least one first radiating layer. The at least one first radiating layer is configured to guide an electromagnetic wave radiated from the at least one second radiating layer toward a radiation direction non-perpendicular to the at least one second radiating layer.

In another aspect, an antenna array is provided. The antenna array includes a number of multi-layer antenna assemblies. Each of the multi-layer antenna assemblies includes at least one first radiating layer. Each of the multi-layer antenna assemblies also includes at least one second radiating layer provided below and parallel to the at least one first radiating layer. The at least one second radiating layer overlaps at least partially with the at least one first radiating layer. The at least one first radiating layer is configured to guide an electromagnetic wave radiated from the at least one second radiating layer toward a radiation direction non-perpendicular to the at least one second radiating layer.

In another aspect, a front-end module (FEM) package is provided. The FEM package includes a power management integrated circuit (PMIC). The FEM package also includes a multi-layer antenna assembly. The multi-layer antenna assembly includes at least one first radiating layer. The multi-layer antenna assembly also includes at least one second radiating layer provided below and parallel to the at least one first radiating layer. The at least one second radiating layer overlaps at least partially with the at least one first radiating layer. The at least one first radiating layer is configured to guide an electromagnetic wave radiated from the at least one second radiating layer toward a radiation direction non-perpendicular to the at least one second radiating layer.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1A:
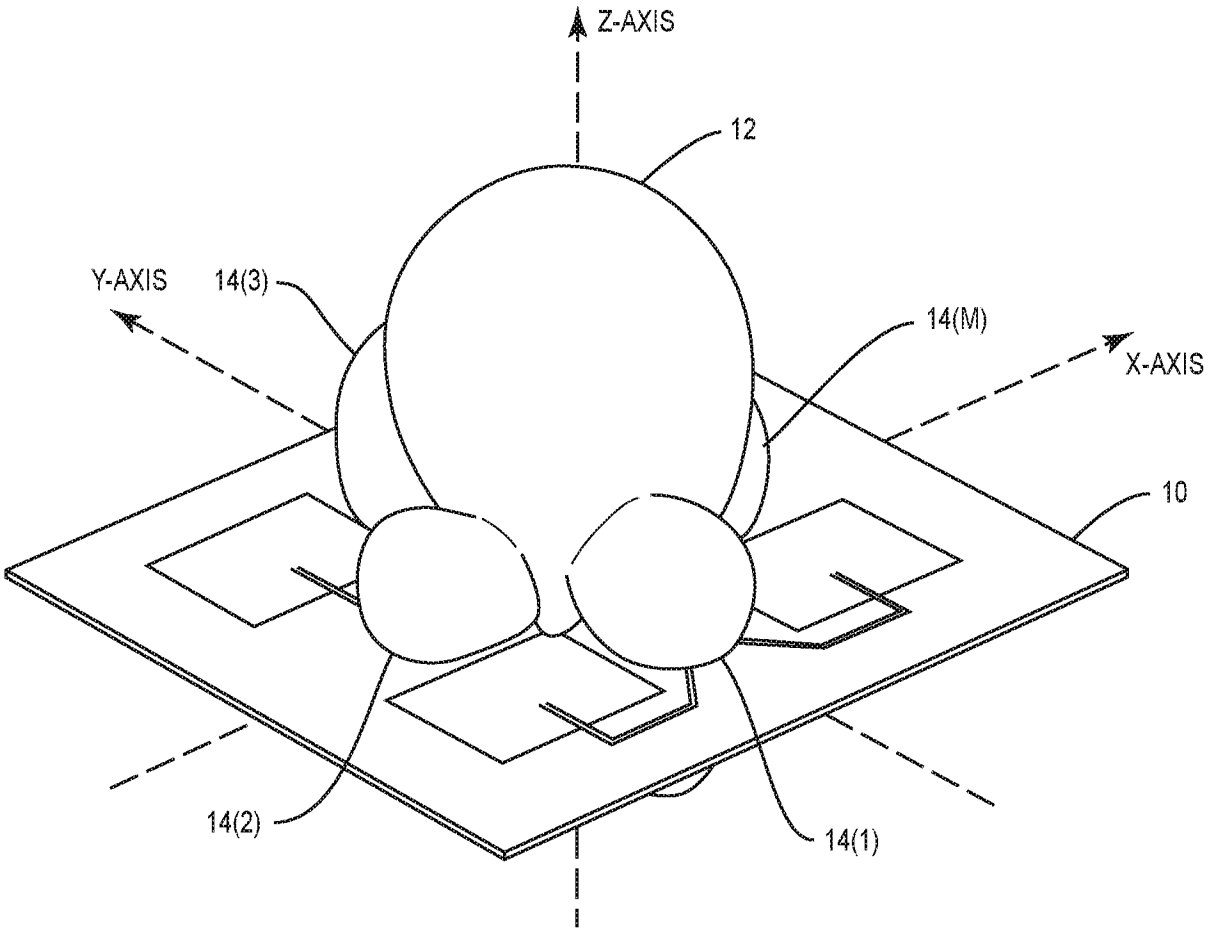
FIG. 1A is a schematic diagram providing an exemplary illustration of a radiation pattern associated with a conventional planar antenna array.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Embodiments of the disclosure relate to a multi-layer antenna assembly and related antenna array. In one aspect, a multi-layer antenna assembly includes a first radiating layer(s) and a second radiating layer(s). The second radiating layer(s) is provided below and in parallel to the first radiating layer(s). The second radiating layer(s) overlaps at least partially with the first radiating layer(s). In this regard, an electromagnetic wave radiated vertically from the second radiating layer(s) is horizontally guided by an overlapping portion of the first radiating layer(s). In another aspect, an antenna array can be configured to include a number of multi-layer antenna assemblies to enable radio frequency (RF) beamforming. By employing the multi-layer antenna assemblies in the antenna array, it may be possible to flexibly and naturally steer an RF beam in a desired direction(s) without causing oversized side lobes, thus helping to improve power efficiency and performance of the antenna array.

Figure 1B:
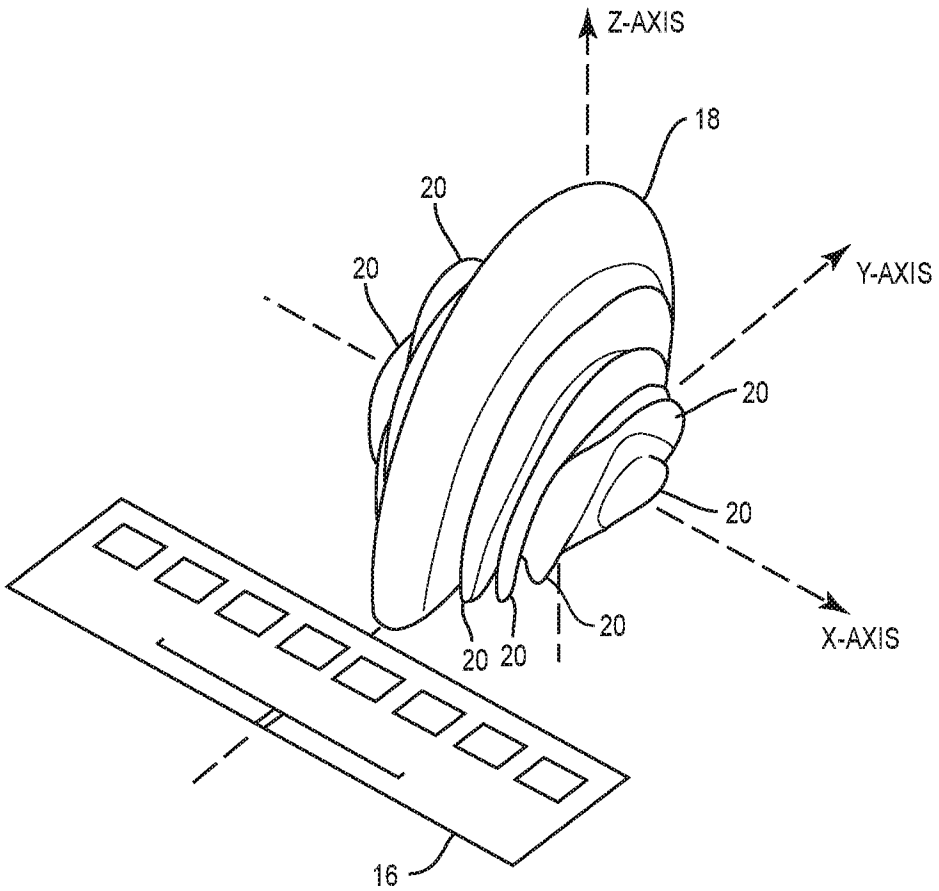
FIG. 1B is a schematic diagram providing an exemplary illustration of a radiation pattern associated with another conventional planar antenna array.

Before discussing the multi-layer antenna assembly and related antenna array of the present disclosure, a brief overview of RF radiation patterns of conventional antenna arrays is provided with reference to FIGS. 1A and 1B. The discussion of specific exemplary aspects of a multi-layer antenna assembly and related antenna array according to the present disclosure starts below with reference to FIG. 2A.

FIG. 1A is a schematic diagram providing an exemplary illustration of a radiation pattern associated with a conventional planar antenna array 10. As shown in FIG. 1A, the conventional planar antenna array 10 radiates a main lobe 12 along a Z-axis that is perpendicular to the X-axis and the Y-axis. In addition to the main lobe 12, the conventional planar antenna array 10 also generates a number of side lobes 14(1)-14(M) around the main lobe 12.

When the main lobe 12 is steered toward the X-axis, for example, the side lobe 14(2) may be enlarged, thus consuming more radiated power. As such, an increase of radiated power in the side lobe 14(2) may cause the radiated power of the main lobe 12 to reduce. Notably, the conventional planar antenna array 10 may be subject to specific absorption rate (SAR) requirements stipulated by a standard body and/or a regulatory authority. As a result, it may not be possible to increase the radiated power in the main lobe 12 to compensate for the radiated power lost to the side lobe 14(3). Consequently, the main lobe 12 may not be able to reach an intended receiver at a sufficient power level, thus compromising RF performance of the conventional planar antenna array 10.

FIG. 1B is a schematic diagram providing an exemplary illustration of a radiation pattern associated with another conventional planar antenna array 16. As illustrated in FIG. 1B, the conventional planar antenna array 16 radiates a main lobe 18 perpendicular to the conventional planar antenna array 10 and a number of side lobes 20 on both sides of the main lobe 18. Similar to the conventional planar antenna array 10 of FIG. 1A, the conventional planar antenna array 16 may suffer degraded RF performance when the main lobe 18 is steered left or right. As such, it may be desirable to design an antenna array(s) that can overcome the shortcomings of the conventional planar antenna array 10 of FIG. 1A and the conventional planar antenna array 16 of FIG. 1B.

Figure 2A:
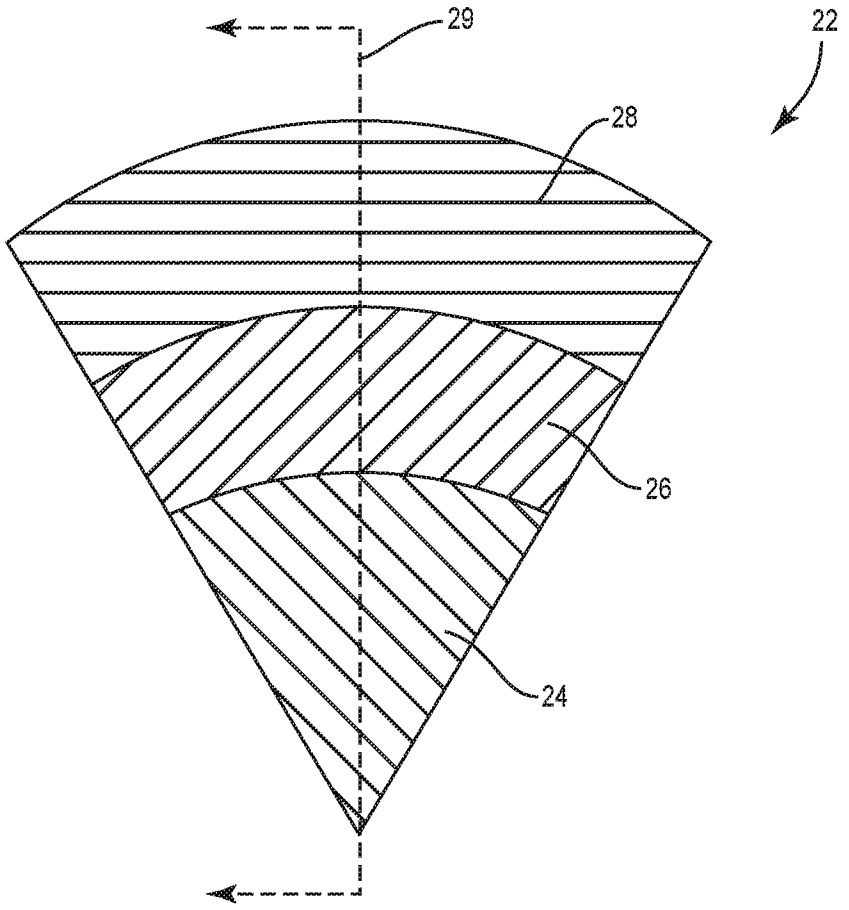
FIG. 2A is a schematic diagram providing a top view of an exemplary multi-layer antenna assembly configured according to an embodiment of the present disclosure.

In this regard, FIG. 2A is a schematic diagram providing a top view of an exemplary multi-layer antenna assembly 22 configured according to an embodiment of the present disclosure. The multi-layer antenna assembly 22 includes a first radiating layer 24 and a second radiating layer 26. The multi-layer antenna assembly 22 may also include a third radiating layer 28 and additional number of radiating layers when necessary.

In a non-limiting example, each of the first radiating layer 24, the second radiating layer 26, and the third radiating layer 28 is a planar radiating layer. In this regard, each of the first radiating layer 24, the second radiating layer 26, and the third radiating layer 28 may be an elliptical sector shaped planar radiating layer, a circular sector shaped planar radiating layer, or any other suitable shapes of planar radiating layers. As shown in FIG. 2A, the first radiating layer 24 has a smaller area compared to the second radiating layer 26, which has a smaller area compared to the third radiating layer 28.

Figure 2B:
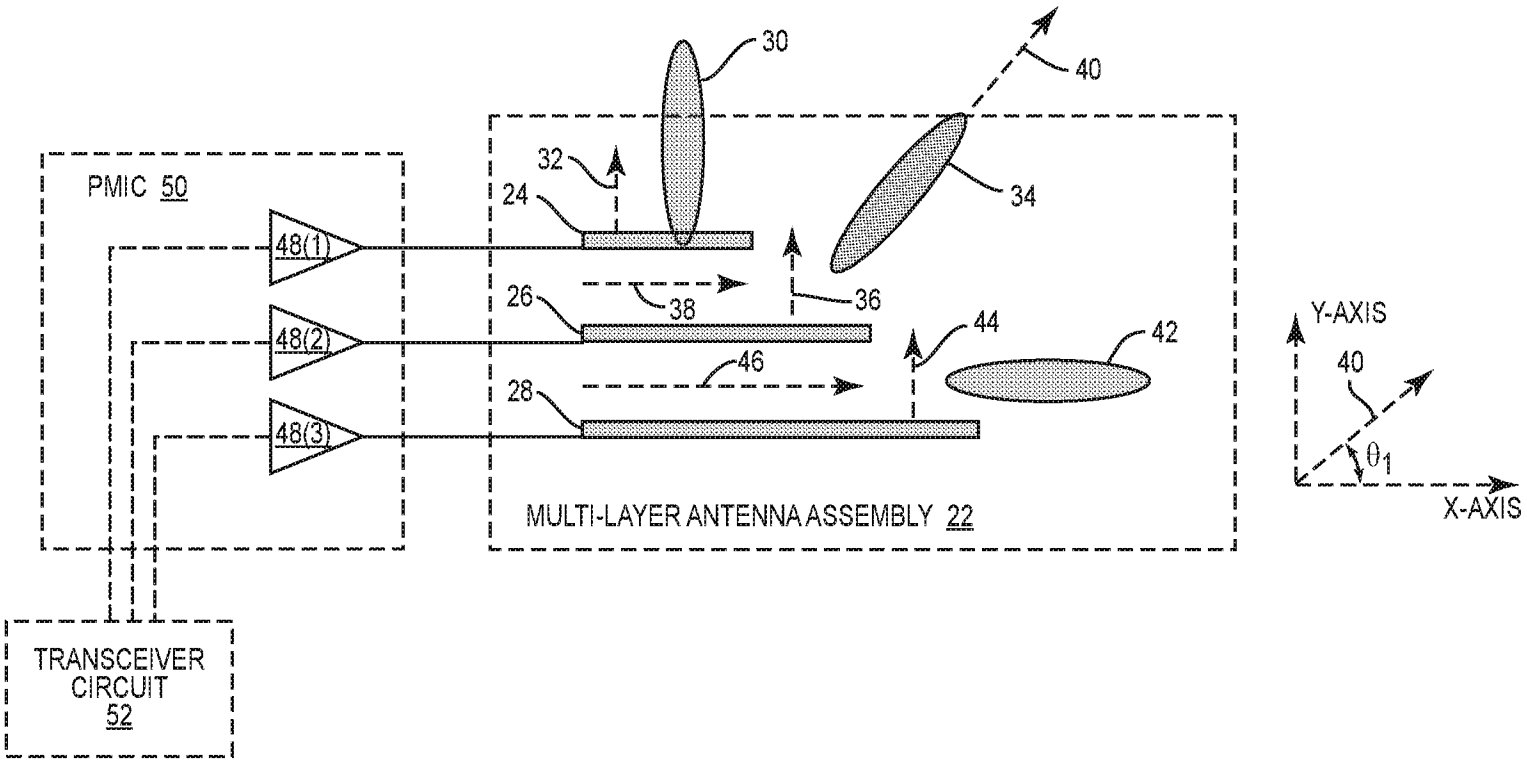
FIG. 2B is a schematic diagram providing a cross-section view of the multi-layer antenna assembly of FIG. 2A.

To help further illustrate the inner structure of the multi-layer antenna assembly 22, a cross-section view is created along a cross-section line 29 and discussed next in FIG. 2B. In this regard, FIG. 2B is a schematic diagram providing a cross-section view of the multi-layer antenna assembly 22 of FIG. 2A.

In a non-limiting example, the multi-layer antenna assembly 22 includes the first radiating layer 24, the second radiating layer 26, and the third radiating layer 28. The first radiating layer 24 is provided in parallel to an X-axis. The second radiating layer 26 is provided below the first radiating layer 24 with respect to a Y-axis and parallel to the first radiating layer 24 with respect to the X-axis. The third radiating layer 28 is provided below the second radiating layer 26 with respect to a Y-axis and parallel to the second radiating layer 26 with respect to the X-axis. In this regard, the first radiating layer 24, the second radiating layer 26, and the third radiating layer 28 are physically separated from each other.

The first radiating layer 24 is so configured to overlap at least partially with the second radiating layer 26. Likewise, the second radiating layer 26 is so configured to overlap at least partially with the third radiating layer 28. As discussed in detail below, the overlapping areas between the first radiating layer 24, the second radiating layer 26, and the third radiating layer 28 play a crucial role in determining radiation directions of the multi-layer antenna assembly 22.

The first radiating layer 24 naturally radiates a first electromagnetic wave 30 in a first radiation direction 32. Herein, the first electromagnetic wave 30 refers generally to a main lobe of the first electromagnetic wave 30. The first radiation direction 32 is perpendicular to the first radiating layer 24 (e.g., along the Y-axis).

The second radiating layer 26 naturally radiates a second electromagnetic wave 34 in a second radiation direction 36 that is perpendicular to the second radiating layer 26 (e.g., along the Y-axis). Herein, the second electromagnetic wave 34 refers generally to a main lobe of the second electromagnetic wave 34. However, a portion of the second electromagnetic wave 34 hits the first radiating layer 24 located above the second radiating layer 26. As a result, the portion of the second electromagnetic wave 34 is guided by the first radiating layer 24 toward a first guided direction 38 horizontal to the second radiating layer 26 (e.g., along the X-axis). In this regard, a portion of the second electromagnetic wave 34 is radiated in the second radiation direction 36, while another portion of the second electromagnetic wave 34 is guided in the first guided direction 38. As such, the first radiating layer 24 can be seen as a "wave guide" to the second radiating layer 26. As a result, the second electromagnetic wave 34 is naturally steered toward a radiation direction 40 non-perpendicular to the second radiating layer 26. As shown in FIG. 2B, the radiation direction 40 forms an acute angle $\theta_1$ relative to the X-axis. In a non-limiting example, the radiation direction 40 is said to be non-perpendicular to the second radiating layer 26 when the acute angle $\theta_1$ is smaller than 85° ($0° < \theta_1 < 85°$)

Notably, the larger the overlapping area between the first radiating layer 24 and the second radiating layer 26, the larger the portion of the second electromagnetic wave 34 is guided toward the first guided direction 38. As a result, the second electromagnetic wave 34 is steered more toward the X-axis (smaller $\theta_1$). In contrast, the smaller the overlapping area between the first radiating layer 24 and the second radiating layer 26, the smaller the portion of the second electromagnetic wave 34 is guided toward the first guided direction 38. As a result, the second electromagnetic wave 34 is steered more toward the Y-axis (larger $\theta_1$). Accordingly, it may be possible to substantially suppress side lobes associated with the second electromagnetic wave 34 when steering the second electromagnetic wave 34 toward the radiation direction 40.

The third radiating layer 28 naturally radiates a third electromagnetic wave 42 in a third radiation direction 44 that is perpendicular to the third radiating layer 28 (e.g., along the Y-axis). Herein, the third electromagnetic wave 42 refers generally to a main lobe of the third electromagnetic wave 42. However, given that a larger portion of the third radiating layer 28 overlaps with the second radiating layer 26, a larger portion of the third electromagnetic wave 42 hits the second radiating layer 26 located above the third radiating layer 28. As a result, the second radiating layer 26 guides the larger portion of the third electromagnetic wave 42 toward a second guided direction 46 horizontal to the third radiating layer 28 (e.g., along the X-axis). In this regard, a smaller portion of the third electromagnetic wave 42 is radiated in the third radiation direction 44, while the larger portion of the third electromagnetic wave 42 is guided in the second guided direction 46. As such, the second radiating layer 26 can be seen as the "wave guide" to the third radiating layer 28. As a result, the third electromagnetic wave 42 is naturally steered toward the X-axis. Accordingly, it may be possible to substantially suppress side lobes associated with the third electromagnetic wave 42 when steering the third electromagnetic wave 42 toward the X-axis.

In a non-limiting example, the first radiating layer 24, the second radiating layer 26, and the third radiating layer 28 may be coupled to a number of amplifier circuits 48(1)-48(3), respectively. The amplifier circuits 48(1)-48(3) may be provided in a power management integrated circuit (PMIC) 50 and coupled to a transceiver circuit 52. Each of the amplifier circuits 48(1)-48(3) may be individually or collectively controlled (e.g., by a controller circuit) to excite the first radiating layer 24, the second radiating layer 36, and/or the third radiating layer 28 to flexibly steer the first electromagnetic wave 30, the second electromagnetic wave 34, and/or the third electromagnetic wave 42 in different radiation directions. As discussed in the examples below, the amplifier circuits 48(1)-48(3) are turned on only as needed, thus helping to improve efficiency of the amplifier circuits 48(1)-48(3) and reduce power consumption/heat dissipation in the PIMC 50.

In one example, the amplifier circuit 48(1) is turned on, while the amplifier circuits 48(2), 48(3) are turned off. Accordingly, the first radiating layer 24 is excited to radiate the first electromagnetic wave 30 in the first radiation direction 32.

In another example, the amplifier circuit 48(2) is turned on, while the amplifier circuits 48(1), 48(3) are turned off. Accordingly, the second radiating layer 26 is excited to radiate the second electromagnetic wave 34 in the radiation direction 40.

In another example, the amplifier circuit 48(3) is turned on, while the amplifier circuits 48(1), 48(2) are turned off. Accordingly, the third radiating layer 28 is excited to radiate the third electromagnetic wave 42 along the X-axis.

In another example, the amplifier circuits 48(1), 48(2) are turned on, while the amplifier circuit 48(3) is turned off. Accordingly, the first radiating layer 24 and the second radiating layer 26 are excited to radiate the first electromagnetic wave 30 and the second electromagnetic wave 34 in the first radiation direction 32 and the radiation direction 40, respectively.

In another example, the amplifier circuits 48(2), 48(3) are turned on, while the amplifier circuit 48(1) is turned off. Accordingly, the second radiating layer 26 and the third radiating layer 28 are excited to radiate the second electromagnetic wave 34 and the third electromagnetic wave 42 in the radiation direction 40 and along the X-axis, respectively.

In another example, the amplifier circuits 48(1), 48(3) are turned on, while the amplifier circuit 48(2) is turned off. Accordingly, the first radiating layer 24 and the third radiating layer 28 are excited to radiate the first electromagnetic wave 30 and the third electromagnetic wave 42 in the first radiation direction 32 and along the X-axis, respectively.

Figure 3:
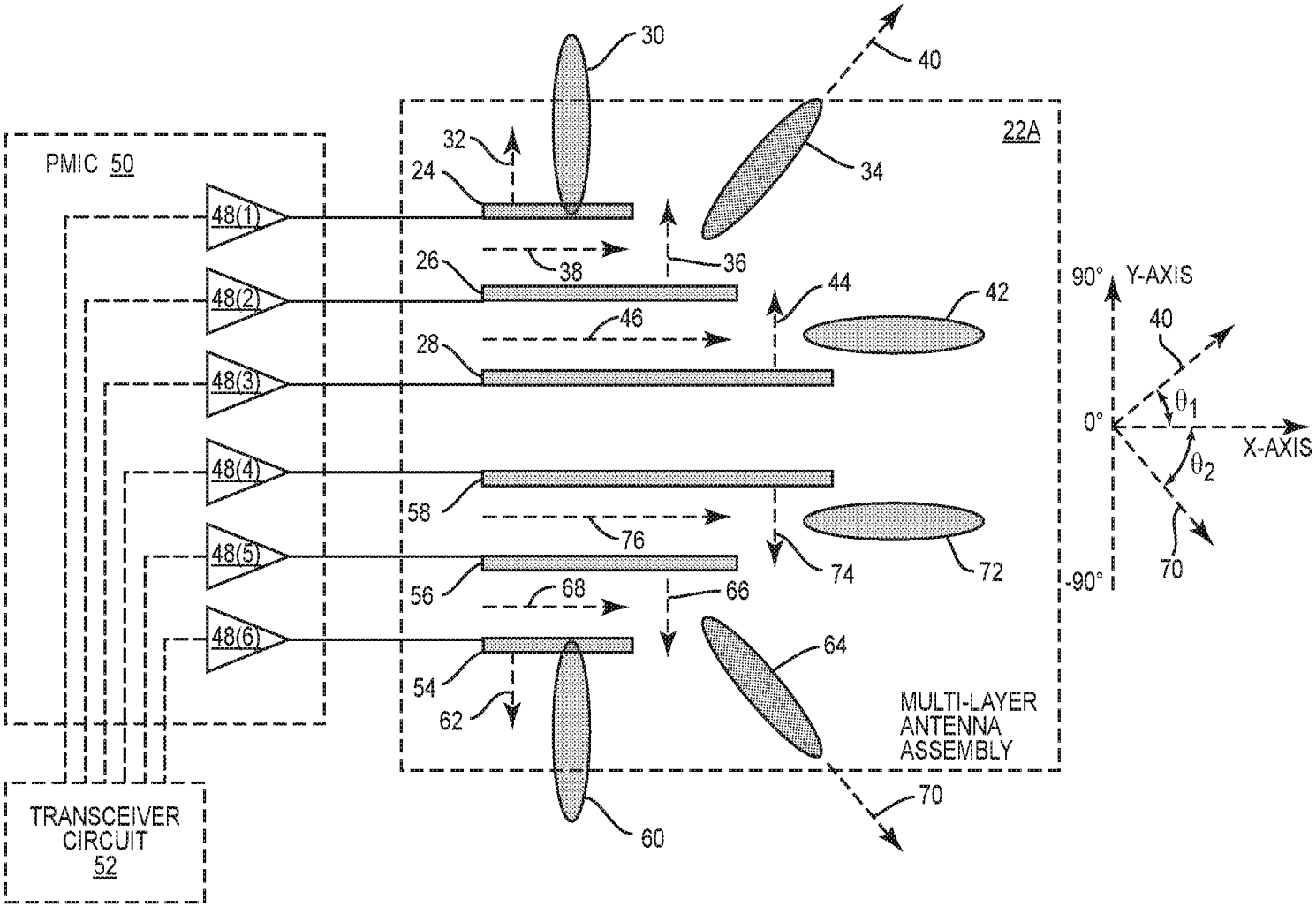
FIG. 3 is a schematic diagram of an exemplary multi-layer antenna assembly configured to cover a 180° radiation angle range.

The multi-layer antenna assembly 22 can effectively cover a radiation angle range between 0° and 90°. The multi-layer antenna assembly 22 may be configured to include additional radiating layers to cover an even wider radiation angle range. In this regard, FIG. 3 is a schematic diagram of an exemplary multi-layer antenna assembly 22A configured to cover a 180° radiation angle range. Common elements between FIGS. 2B and 3 are shown therein with common element numbers and will not be re-described herein.

The multi-layer antenna assembly 22A includes the first radiating layer 24 (also referred to as "first upper radiating layer" herein), the second radiating layer 26 (also referred to as "second upper radiating layer" herein), and the third radiating layer 28 (also referred to as "third upper radiating layer" herein).

The multi-layer antenna assembly 22A further includes a first lower radiating layer 54, a second lower radiating layer 56, and a third lower radiating layer 58. The first lower radiating layer 54 naturally radiates a fourth electromagnetic wave 60 in a fourth radiation direction 62 that is perpendicular to the first lower radiating layer 54. Herein, the fourth electromagnetic wave 60 refers generally to a main lobe of the fourth electromagnetic wave 60. In this regard, the first lower radiating 54 radiates the fourth electromagnetic wave 60 at a −90° radiation angle.

The second lower radiating layer 56 naturally radiates a fifth electromagnetic wave 64 in a fifth radiation direction 66 that is perpendicular to the second lower radiating layer 56. Herein, the fifth electromagnetic wave 64 refers generally to a main lobe of the fifth electromagnetic wave 64. However, the first lower radiating layer 54 functions as the "wave guide" to guide a portion of the fifth electromagnetic wave 64 in a third guided direction 68 that is parallel to the second lower radiating layer 56. As a result, the fifth electromagnetic wave 64 is guided to a radiation direction 70 non-perpendicular to the second lower radiating layer 56. As shown in FIG. 3, the radiation direction 70 forms a negative acute angle $\theta_2$ relative to the X-axis. In a non-limiting example, the radiation direction 70 is said to be non-perpendicular to the second lower radiating layer 56 when the negative acute angle $\theta_2$ is greater than −85° ($-85° < \theta_2 < 0°$).

The third lower radiating layer 58 naturally radiates a sixth electromagnetic wave 72 in a sixth radiation direction 74 that is perpendicular to the third lower radiating layer 58. Herein, the sixth electromagnetic wave 72 refers generally to a main lobe of the sixth electromagnetic wave 72. However, the second lower radiating layer 56 functions as the "wave guide" to guide a large portion of the sixth electromagnetic wave 72 toward a fourth guided direction 76 that is parallel to the third lower radiating layer 58. As a result, the sixth electromagnetic wave 72 is steered toward the X-axis.

The first lower radiating layer 54, the second lower radiating layer 56, and the third lower radiating layer 58 can be coupled to additional amplifier circuits 48(4)-48(6), respectively. The amplifier circuits 48(1)-48(6) can be individually or collectively controlled such that the multi-layer antenna assembly 22A can radiate the first electromagnetic wave 30, the second electromagnetic wave 34, the third electromagnetic wave 42, the fourth electromagnetic wave 60, the fifth electromagnetic wave 64, and/or the sixth electromagnetic wave 72 based on specific radiation scenarios. Collectively, the multi-layer antenna assembly 22A can be configured to provide a 180° (−90° to 90°) radiation angle range.

The multi-layer antenna assembly 22 of FIG. 2B and/or the multi-layer antenna assembly 22A of FIG. 3 may be integrated with the PMIC 50 into a front-end module (FEM) package, as discussed next in FIGS. 4A and 4B.

Figure 4A:
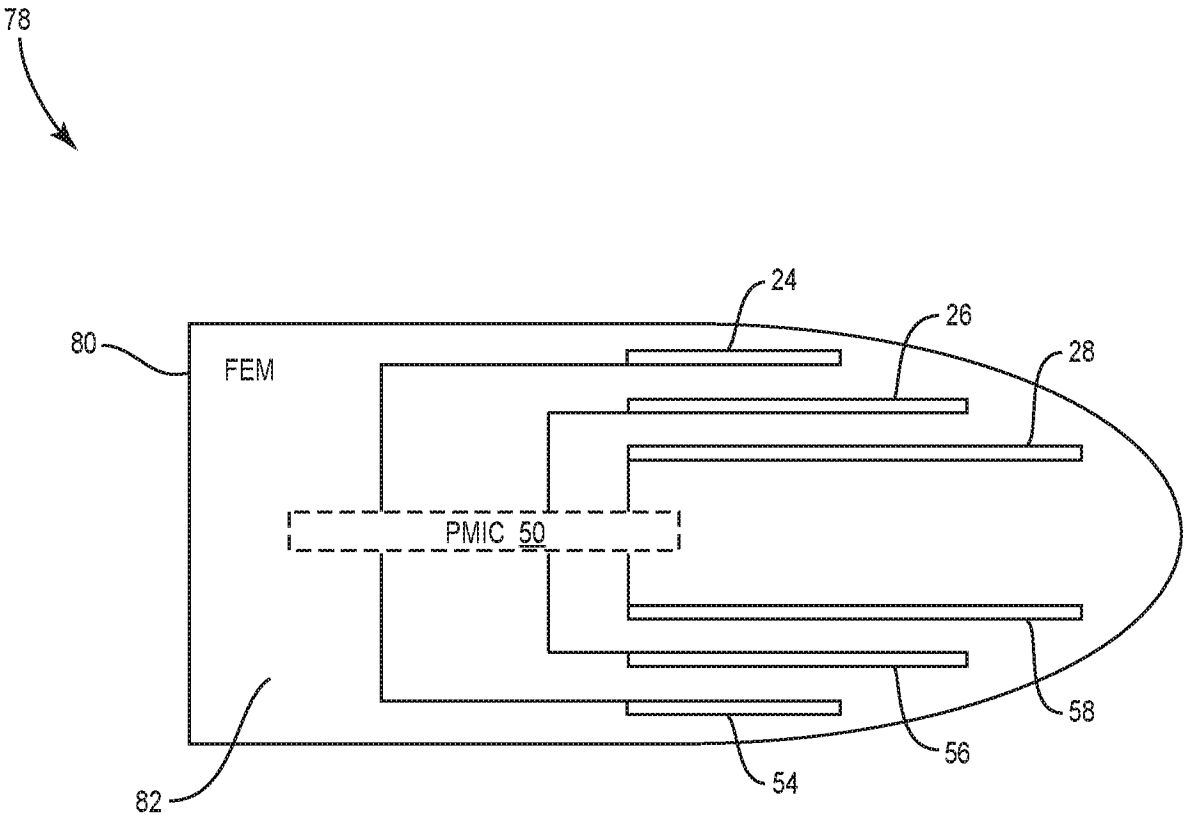
FIG. 4A is a schematic diagram providing a cross-section view of an exemplary front-end module (FEM) package having a curved edge profile.

In this regard, FIG. 4A is a schematic diagram providing a cross-section view of an exemplary FEM package 78 having a curved edge profile. Common elements between FIGS. 3 and 4A are shown therein with common element numbers and will not be re-described herein.

The FEM package 78 may be said to be in a curved edge profile when at least a portion of an outer edge 80 is in a curved shape. Inside the FEM package 78 the first radiating layer 24, the second radiating layer 26, the third radiating layer 28, the first lower radiating layer 54, the second lower radiating layer 56, and the third lower radiating layer 58 may be separated by at least one insulator 82 having a uniform permittivity. Alternatively, the at least one insulator 82 may include a number of different insulators having different permittivities. In a non-limiting example, the different insulators can be so selected to help reduce electromagnetic wave reflection in the FEM package 78.

Figure 4B:
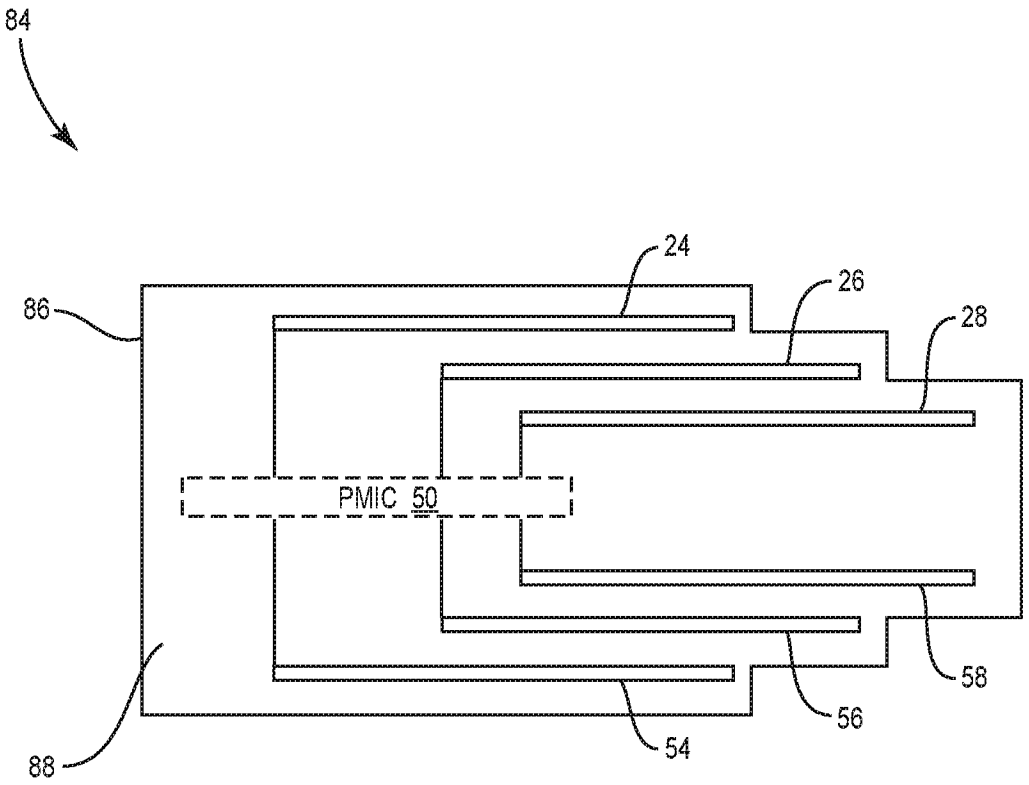
FIG. 4B is a schematic diagram providing a cross-section view of an exemplary FEM package having a laddered edge profile.

FIG. 4B is a schematic diagram providing a cross-section view of an exemplary FEM package 84 having a laddered edge profile. Common elements between FIGS. 3 and 4B are shown therein with common element numbers and will not be re-described herein.

The FEM package 84 may be said to be in a laddered edge profile when at least a portion of an outer edge 86 is in a laddered shape. Inside the FEM package 84 the first radiating layer 24, the second radiating layer 26, the third radiating layer 28, the first lower radiating layer 54, the second lower radiating layer 56, and the third lower radiating layer 58 may be separated by at least one insulator 88 having a uniform permittivity. Alternatively, the at least one insulator 88 may include a number of different insulators having different permittivities. In a non-limiting example, the different insulators can be so selected to help reduce electromagnetic wave reflection in the FEM package 84.

Figure 5:
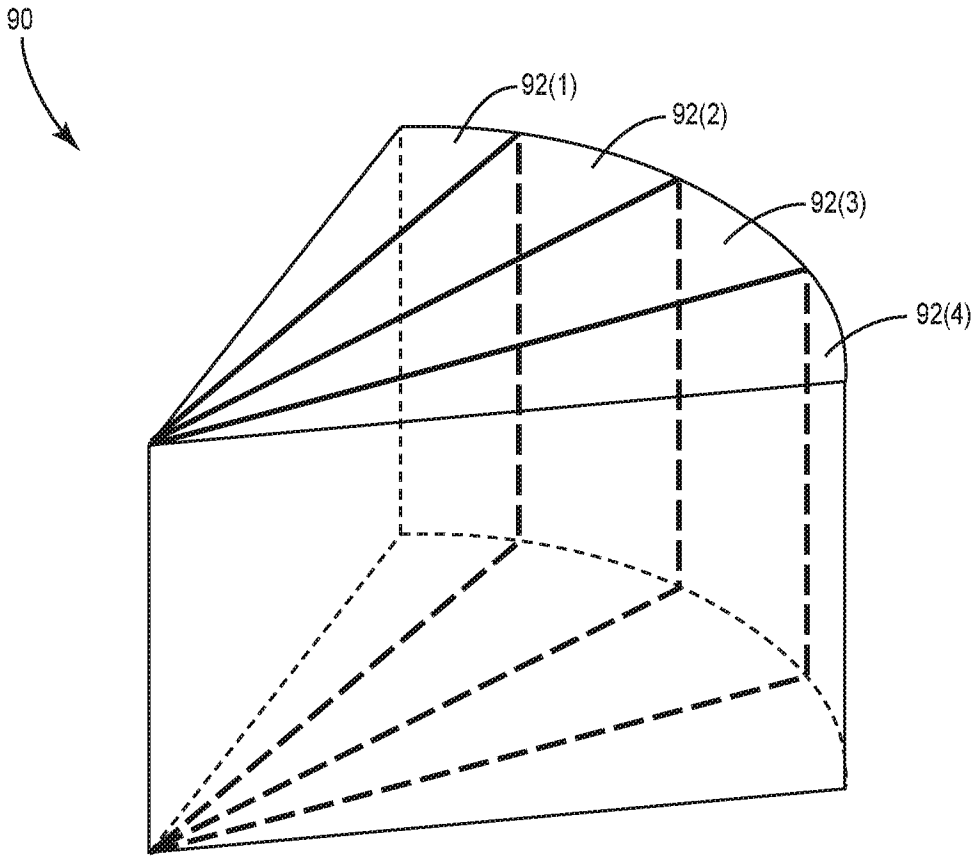
FIG. 5 is a schematic diagram providing a three-dimensional (3D) view of an exemplary antenna array 90 configured according to an embodiment of the present disclosure.

A number of the FEM package 78 of FIG. 4A or the FEM package 84 can be employed to form a multi-layer antenna array. In this regard, FIG. 5 is a schematic diagram providing a three-dimensional (3D) view of an exemplary antenna array 90 configured according to an embodiment of the present disclosure.

The antenna array 90 includes a number of FEM packages 92(1)-92(4). Each of the FEM packages 92(1)-92(4) can be either the FEM package 78 of FIG. 4A or the FEM package 84 of FIG. 4B. Accordingly, each of the FEM packages 92(1)-92(4) includes either the multi-layer antenna assembly 22 of FIG. 2B or the multi-layer antenna assembly 22A of FIG. 3. Although the antenna array 90 is illustrated based on four FEM packages, it should be appreciated that the antenna array 90 can be configured to include more or less than four FEM packages based on usage scenarios.

The antenna array 90 may be provided in a wireless communication apparatus of various form factors. In this regard, FIG. 6A is a schematic diagram of an exemplary wireless communication apparatus 94 in a form factor having four curved edges 96. In a non-limiting example, the antenna array 90 of FIG. 5 can be provided in close proximity to each of the four curved edges 96.

Figure 6B:
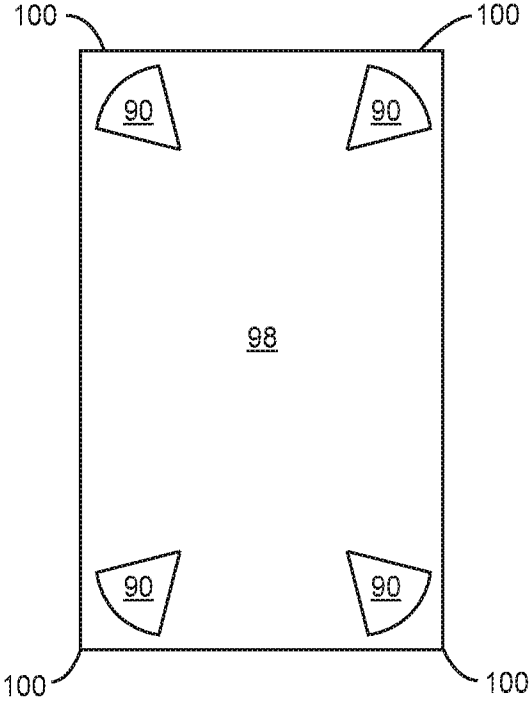
FIG. 6B is a schematic diagram of an exemplary wireless communication apparatus in a form factor having four L-shaped edges.
Figure 6A:
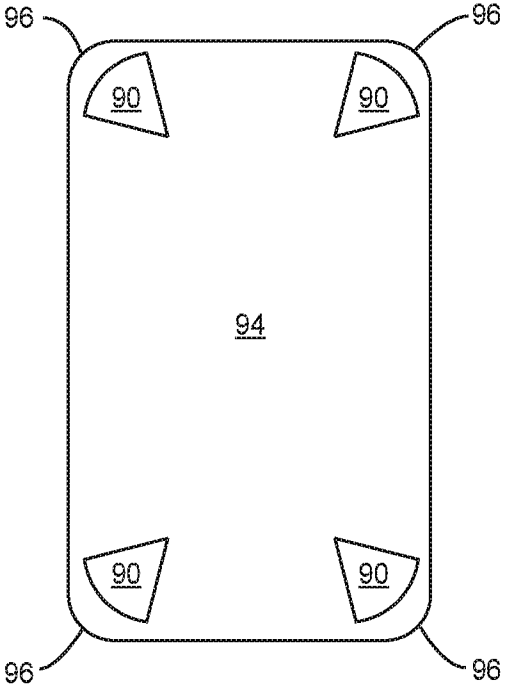
FIG. 6A is a schematic diagram of an exemplary wireless communication apparatus in a form factor having four curved edges.

FIG. 6B is a schematic diagram of an exemplary wireless communication apparatus 98 in a form factor having four L-shaped edges 100. In a non-limiting example, the antenna array 90 of FIG. 5 can be provided in close proximity to each of the four L-shaped edges 100. It should be appreciated that the antenna array 90 is not limited to any specific type of form factor.

Those skilled in the art will recognize improvements and modifications to the preferred embodiments of the present disclosure. All such improvements and modifications are considered within the scope of the concepts disclosed herein and the claims that follow.

What is claimed is:

1. A multi-layer antenna assembly comprising:

at least one first radiating layer; and at least one second radiating layer provided below and parallel to the at least one first radiating layer, the at least one second radiating layer overlapping at least partially with the at least one first radiating layer;

wherein the at least one first radiating layer is configured to guide an electromagnetic wave radiated from the at least one second radiating layer toward a radiation direction non-perpendicular and having an acute angle relative to the at least one second radiating layer and the acute angle is inversely related to an overlapping area between the at least one first radiating layer and the at least one second radiating layer.

2. The multi-layer antenna assembly of claim 1 wherein the at least one first radiating layer has a smaller area than the at least one second radiating layer.

3. The multi-layer antenna assembly of claim 1 further comprising at least one third radiating layer provided below and parallel to the at least one second radiating layer, the at least one third radiating layer overlapping at least partially with the at least one second radiating layer, wherein the at least one second radiating layer is configured to guide a second electromagnetic wave radiated from the at least one third radiating layer toward a second radiating direction non-perpendicular to the at least one third radiating layer.

4. The multi-layer antenna assembly of claim 3 wherein:

the at least one first radiating layer has a smaller area than the at least one second radiating layer; and the at least one second radiating layer has a smaller area than the at least one third radiating layer.

5. The multi-layer antenna assembly of claim 3 wherein the second electromagnetic wave is radiated at a smaller acute angle relative to the at least one third radiating layer compared to the acute angle between the radiation direction of the electromagnetic wave and the at least one second radiating layer.

6. The multi-layer antenna assembly of claim 3 where each of the at least one first radiating layer, the at least one second radiating layer, and the at least one third radiating layer is an elliptical sector shaped planar radiating layer.

7. The multi-layer antenna assembly of claim 3 where each of the at least one first radiating layer, the at least one second radiating layer, and the at least one third radiating layer is a circular sector shaped planar radiating layer.

8. The multi-layer antenna assembly of claim 3 wherein:

the at least one first radiating layer comprises a first upper radiating layer and a first lower radiating layer;

the at least one second radiating layer comprises a second upper radiating layer and a second lower radiating layer; and the at least one third radiating layer comprises a third upper radiating layer and a third lower radiating layer.

9. The multi-layer antenna assembly of claim 8 wherein:

the second upper radiating layer is provided below and parallel to the first upper radiating layer, the second upper radiating layer overlapping at least partially with the first upper radiating layer;

the third upper radiating layer is provided below and parallel to the second upper radiating layer, the third upper radiating layer overlapping at least partially with the second upper radiating layer;

the third lower radiating layer is provided below and parallel to the third upper radiating layer, the third lower radiating layer overlapping at least partially with the third upper radiating layer;

the second lower radiating layer is provided below and parallel to the third lower radiating layer, the second lower radiating layer overlapping at least partially with the third lower radiating layer; and the first lower radiating layer is provided below and parallel to the second lower radiating layer, the first lower radiating layer overlapping at least partially with the second lower radiating layer.

10. An antenna array comprising a plurality of multi-layer antenna assemblies, each of the plurality of multi-layer antenna assemblies comprising:

at least one first radiating layer; and at least one second radiating layer provided below and parallel to the at least one first radiating layer, the at least one second radiating layer overlapping at least partially with the at least one first radiating layer;

wherein the at least one first radiating layer is configured to guide an electromagnetic wave radiated from the at least one second radiating layer toward a radiation direction non-perpendicular and having an acute angle relative to the at least one second radiating layer and the acute angle is inversely related to an overlapping area between the at least one first radiating layer and the at least one second radiating layer.

11. The antenna array of claim 10 wherein each of the plurality of multi-layer antenna assemblies further comprises at least one third radiating layer provided below and parallel to the at least one second radiating layer, the at least one third radiating layer overlapping at least partially with the at least one second radiating layer, wherein the at least one second radiating layer is configured to guide a second electromagnetic wave radiated from the at least one third radiating layer toward a second radiating direction non-perpendicular to the at least one third radiating layer.

12. The antenna array of claim 11 wherein:

the at least one first radiating layer has a smaller area than the at least one second radiating layer; and the at least one second radiating layer has a smaller area than the at least one third radiating layer.

13. The antenna array of claim 11 wherein the second electromagnetic wave is radiated at a smaller acute angle relative to the at least one third radiating layer compared to the acute angle between the radiation direction of the electromagnetic wave and the at least one second radiating layer.

14. A front-end module (FEM) package comprising:

a power management integrated circuit (PMIC); and a multi-layer antenna assembly comprising:

at least one first radiating layer; and at least one second radiating layer provided below and parallel to the at least one first radiating layer, the at least one second radiating layer overlapping at least partially with the at least one first radiating layer;

wherein the at least one first radiating layer is configured to guide an electromagnetic wave radiated from the at least one second radiating layer toward a radiation direction non-perpendicular and having an acute angle relative to the at least one second radiating layer and the acute angle is inversely related to an overlapping area between the at least one first radiating layer and the at least one second radiating layer.

15. The FEM package of claim 14 wherein the multi-layer antenna assembly further comprises at least one third radiating layer provided below and parallel to the at least one second radiating layer, the at least one third radiating layer overlapping at least partially with the at least one second radiating layer, wherein the at least one second radiating layer is configured to guide a second electromagnetic wave radiated from the at least one third radiating layer toward a second radiating direction non-perpendicular to the at least one third radiating layer.

16. The FEM package of claim 15 wherein the PMIC comprises a plurality of amplifier circuits configured to excite the at least one first radiating layer, the at least one second radiating layer, and the at least one third radiating layer.

17. The FEM package of claim 15 wherein the at least one first radiating layer, the at least one second radiating layer, and the at least one third radiating layer are separated by an insulator having a uniform permittivity.

18. The FEM package of claim 15 wherein the at least one first radiating layer, the at least one second radiating layer, and the at least one third radiating layer are separated by a plurality of insulators of different permittivities.

19. The FEM package of claim 15 wherein the FEM package has a curved edge profile.

20. The FEM package of claim 15 wherein the FEM package has a laddered edge profile.

* * * * *